US006241095B1

(12) United States Patent
Yencheng

(10) Patent No.: US 6,241,095 B1
(45) Date of Patent: Jun. 5, 2001

(54) THREE-DIMENSIONAL ROTATING CUP

(76) Inventor: Chin Yeh Yencheng, Rm. 4DO9, No. 5 Sec. 5, Hsin Yih Rd., Taipei (TW)

( * ) Notice: Subject to any disclaimer, the term of this patent is extended or adjusted under 35 U.S.C. 154(b) by 0 days.

(21) Appl. No.: 09/438,967

(22) Filed: Nov. 12, 1999

(51) Int. Cl.[7] ..... B65D 85/00; B65D 3/22; G09F 3/20

(52) U.S. Cl. ..... 206/459.1; 40/324; 40/661; 220/62.14; 220/62.18; 428/13; 446/267

(58) Field of Search ..... 206/459.1; 215/12.1, 215/13.1; 220/62.12, 62.14, 62.18; 40/306, 310, 324, 660, 661, 334, 326; 446/267; 428/13, 321.5

(56) References Cited

U.S. PATENT DOCUMENTS 3,293,787 * 12/1966 McMahon ..... 40/306
4,402,195 * 9/1983 Campbell ..... 215/12.1
4,570,454 * 2/1986 Campbell ..... 215/13.1 X
4,928,412 * 5/1990 Nishiyama ..... 40/324
4,941,590 * 7/1990 Pantaleo et al. ..... 428/13 X
5,036,998 * 8/1991 Dunn ..... 40/306 X
5,104,699 * 4/1992 Pantaleo et al. ..... 428/13
5,339,982 * 8/1994 Tardie ..... 220/708
5,553,735 * 9/1996 Kimura ..... 40/324 X
5,557,867 * 9/1996 Sugawara ..... 40/493
5,884,421 * 3/1999 Key ..... 40/306
5,894,948 * 4/1999 Yeh ..... 215/12.1

* cited by examiner

*Primary Examiner*—Bryon P. Gehman
(74) *Attorney, Agent, or Firm*—Bacon & Thomas PLLC

(57) ABSTRACT

A three-dimensional rotating cup includes an exterior fixed cup, an interior fixed cup and a middle rotating layer. The middle rotating layer is inside the exterior fixed cup. The interior fixed cup is inside the middle rotating layer and a transparent fluid is filled inside the clearance between the interior fixed cup and the exterior fixed cup. Furthermore, extending outwardly from the edge of the interior fixed cup is a protruding flange. The bottom of the protruding flange is joined to the top of the edge of the exterior fixed cup. The inside and outside walls of the exterior fixed cup and middle rotating layer and the outside wall of the interior fixed cup include figure paintings.

3 Claims, 9 Drawing Sheets

THREE-DIMENSIONAL ROTATING CUP

BACKGROUND OF THE INVENTION

1. Field of the Invention

The subject invention is a 3-dimensional rotating cup, that combines aesthetics with practicality.

2. Background of the Invention

FIG. 9 illustrates a conventional cup 2. Because the outer figure or design (not shown) on the cup is fixed, the user may easily tire looking at a fixed figure. Because there is no heat insulation in a conventional cup, the fluid contained in a conventional cup will deteriorate due to the influence of external temperature.

SUMMARY OF THE INVENTION

The primary objective of this invention is to provide a three-dimensional rotating cup that combines aesthetics and fun while maintaining its practicability.

The secondary objective of this invention is to provide a three-dimensional rotating cup with an exterior view of changing figures.

To achieve the above objectives, the 3-dimensional rotating cup is characterized as follows: An interior fixed cup is placed inside an exterior fixed cup; an interior rotating layer and an exterior rotating layer are placed inside the interior and exterior fixed cups with a transparent fluid filling the inside of the clearance between the interior and exterior fixed cups; furthermore, extending outwardly from the edge of the interior fixed cup is a protruding flange; the bottom of the protruding flange is joined to the top of the edge of the exterior fixed cup.

BRIEF DESCRIPTION OF DRAWINGS

In order to more fully explain the features and advantages of the present invention, the following preferred embodiments according to the invention are described, as examples only without any limitative character, with reference to the accompanying drawings.

DETAILED DESCRIPTION OF THE PREFERRED EMBODIMENT

Figure 1:
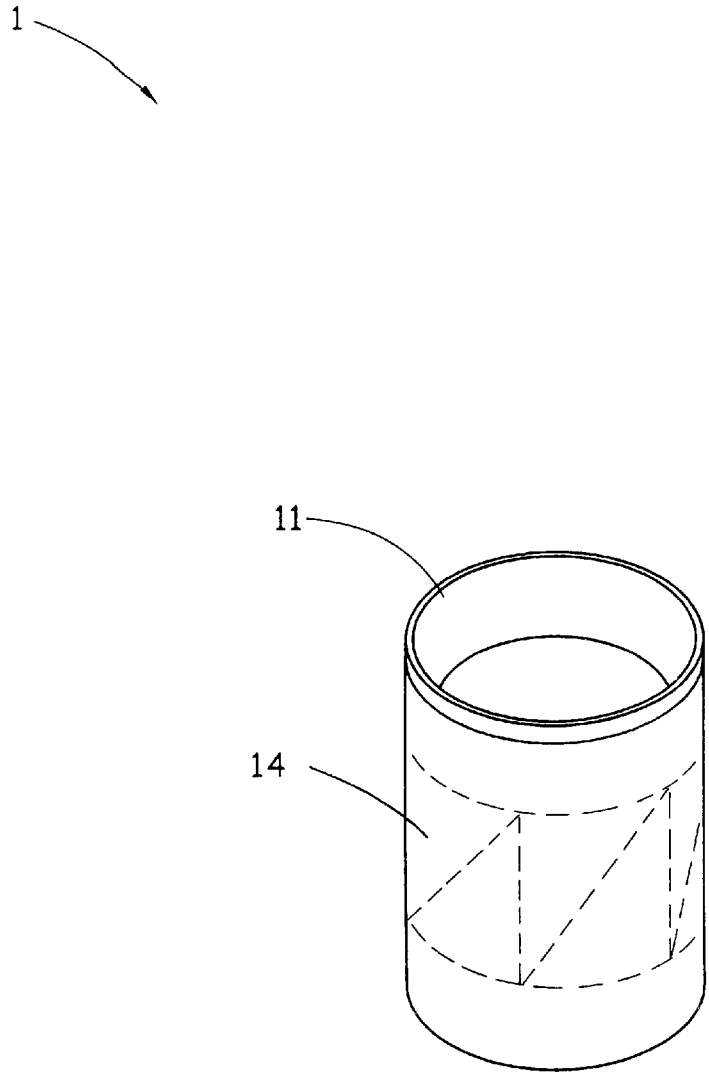
FIG. 1 is a perspective view of the invention.
Figure 2:
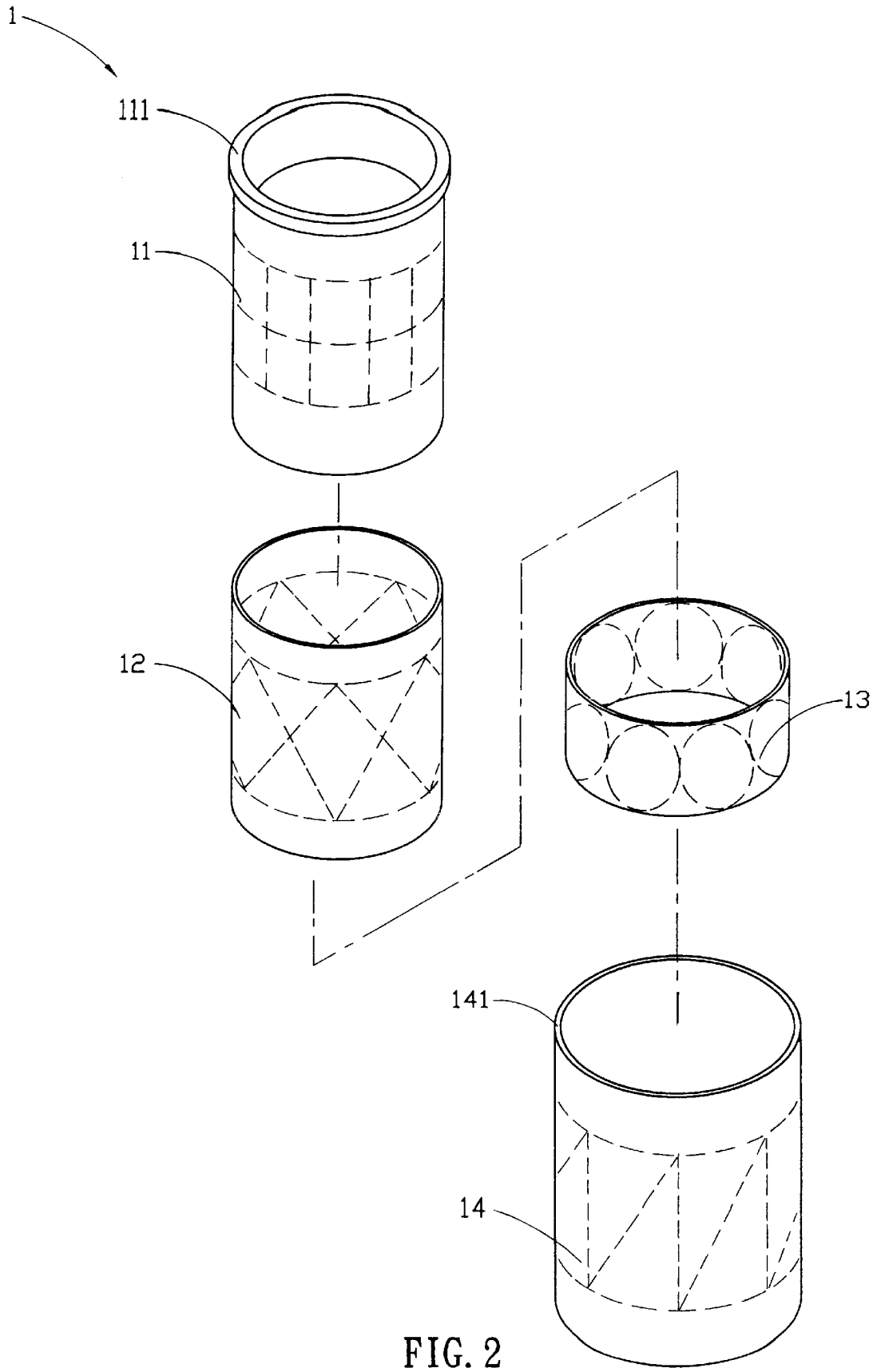
FIG. 2 is an exploded view of the invention.
Figure 3:
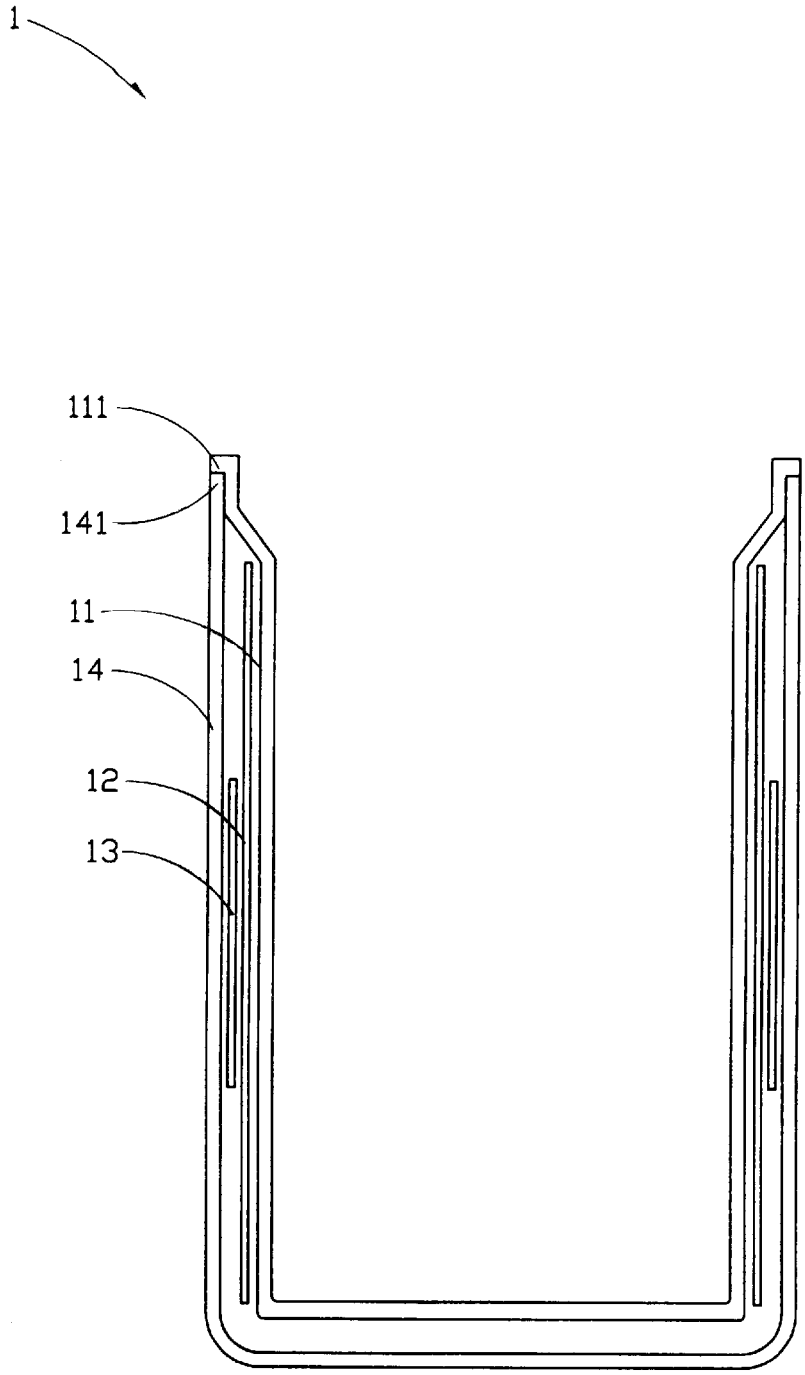
FIG. 3 is a sectional view of the invention.

Referring to FIGS. 1, 2 and 3, the three-dimensional rotating cup 1 is comprised of an exterior fixed cup 14, an interior fixed cup 11, an interior rotating layer 12 and an exterior rotating layer 14. The interior fixed cup 11 is placed inside the exterior fixed cup 14. The interior rotating layer 12 and the exterior rotating layer 13 are placed between the interior fixed cup 11 and the exterior fixed cup 14, while the height of the interior rotating layer 12 is in inverse proportion to the height of the exterior rotating layer 13. The clearance between the interior fixed cup 11 and the exterior fixed cup 14 is filled with a transparent fluid. Extending outward from the edge of the interior fixed cup 11 is a protruding flange 111. The bottom of the protruding flange 111 is joined to the top of the cup edge 141. The inside and outside walls of the exterior fixed cup 14, the interior rotating layer 12 and the exterior rotating layer 13, as well as the outside wall of the interior fixed cup 11 include painted figures (not shown).

Figure 4:
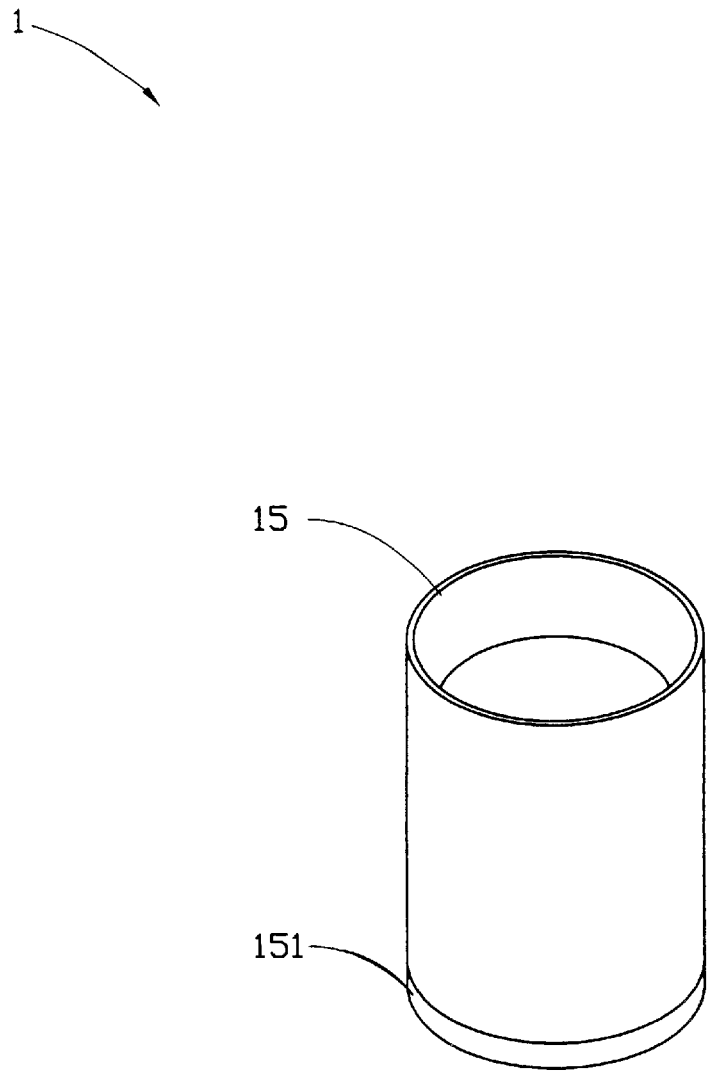
FIG. 4 is a perspective view of the first embodiment of the invention.
Figure 5:
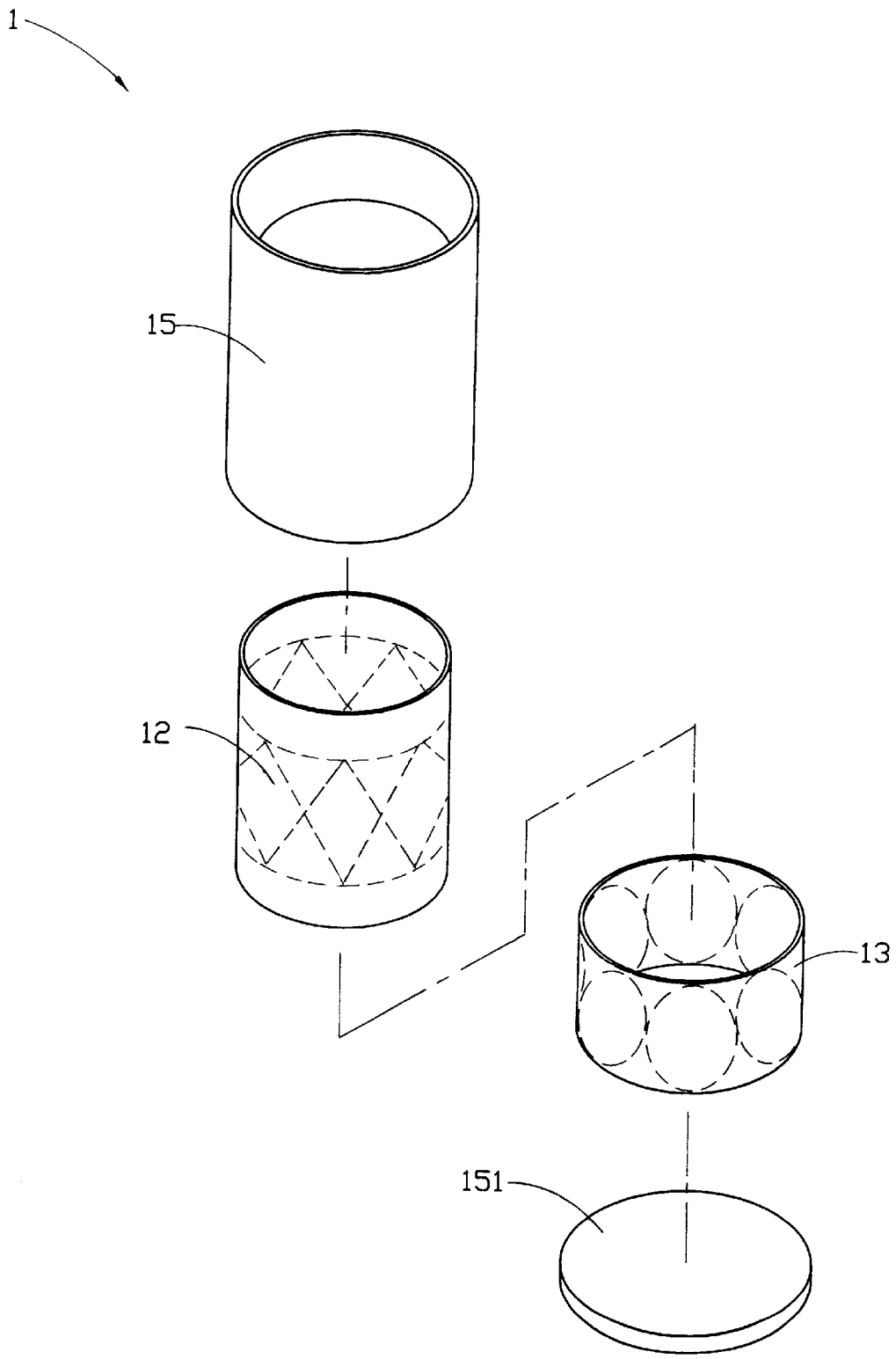
FIG. 5 is an exploded view of the first embodiment of the invention.
Figure 6:
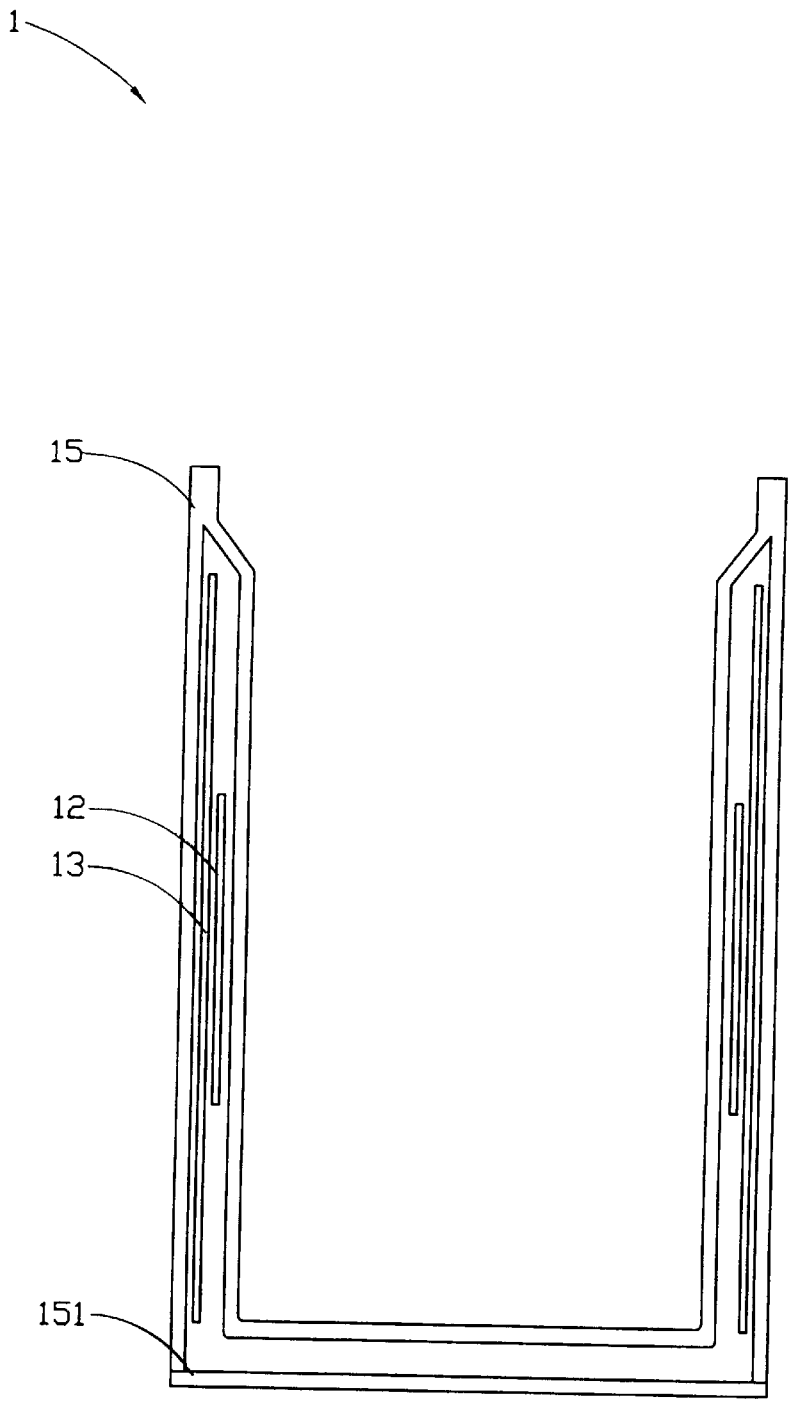
FIG. 6 is a section view of the first embodiment of the invention.
Figure 7:
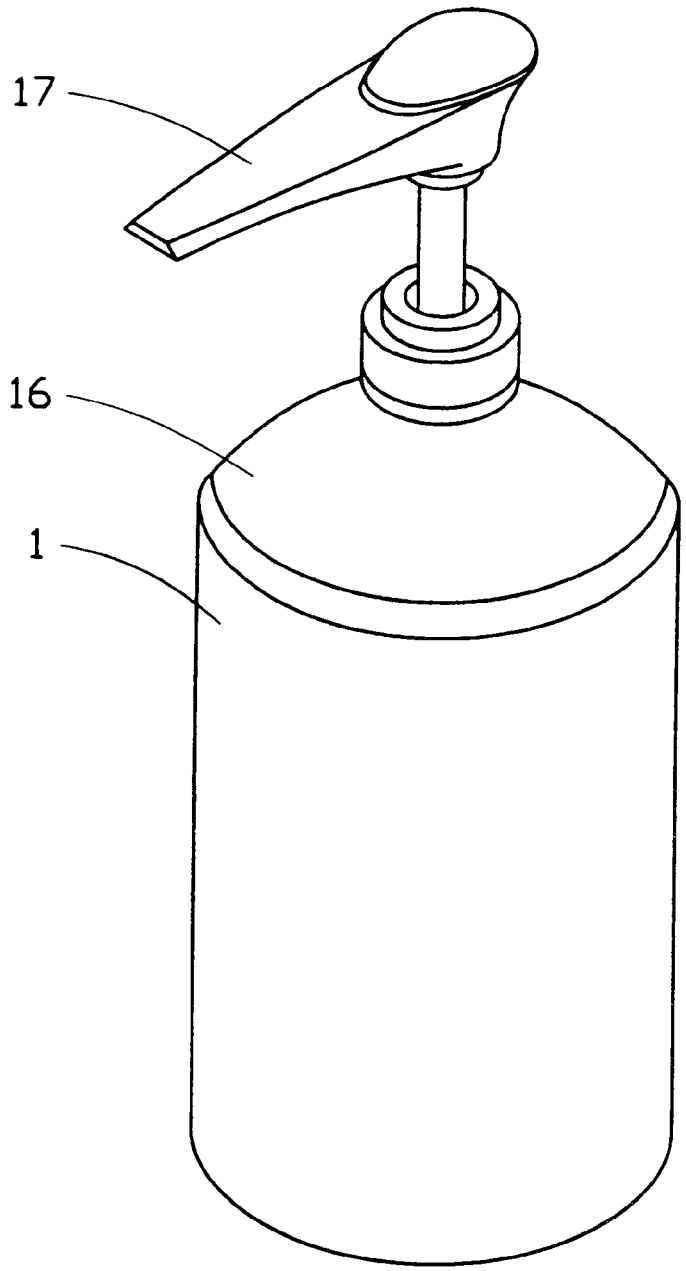
FIG. 7 is an exploded view of the second embodiment of the invention.
Figure 8:
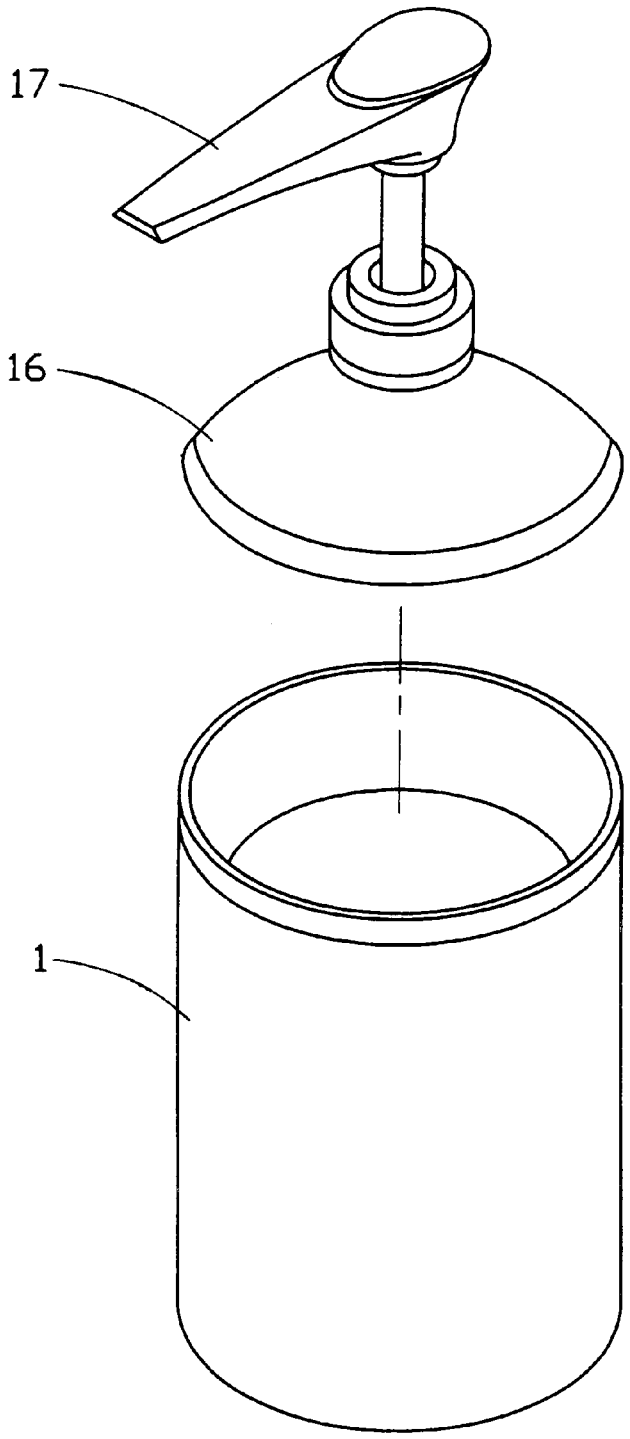
FIG. 8 is a section view of the second embodiment of the invention.
Figure 9:
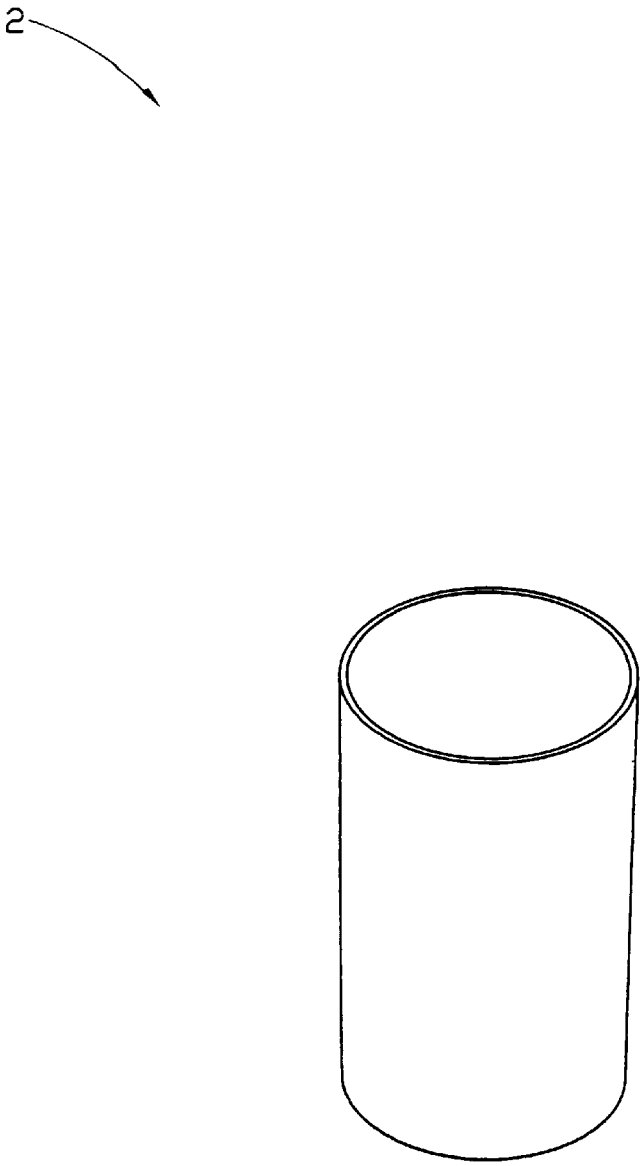
PRIOR ART FIG. 9
FIG. 9 is a perspective view of a prior art.

Various figures and patterns (not shown) are painted on the outside wall of the interior fixed cup 11, the inside and outside walls of the interior rotating layer 12 and the exterior rotating layer of this invention. The interior fixed cup 11 is inside the exterior fixed cup 14. The interior rotating layer 12 and the exterior rotating layer 13 are placed between the exterior fixed cup 14 and the interior fixed cup 11. In the clearance between the interior fixed cup 11 and the exterior fixed cup 14 is filled a transparent fluid and glistening plates (not shown ) that float in the transparent fluid. The bottom of the protruding flange 111 on the cup edge of the interior fixed cup 11 is then attached or glued by ultrasonic waves onto the top of the cup edge 141 of the exterior fixed cup 14. In the embodiment of FIGS. 4–6, the interior fixed cup 11 and the exterior fixed cup 14 are constructed into the monoblock carrying cup unit 15. The opening of the middle or interior rotating layer 12 and the exterior rotating layer 13 are placed at the bottom of the carrying cup 15. After the interior rotating layer 12 and the exterior rotating layer 13 are placed inside the bottom of the carrying cup 15, a transparent fluid and floating glistening pieces were inserted from the bottom of the carrying cup 15. The bottom of the carrying cup 15 was sealed using a bottom cover 151. Referring to the embodiment of FIGS. 7 and 8, the top part of the top cover 16 was then joined using a press switch 17 to become a lotion can.

As described above, a transparent fluid and some glistening pieces were inserted into the space between the interior fixed cup and the exterior fixed cup. Due to the light weight of the middle rotating layer and the glistening pieces in comparison to the weight of the liquid, the interior rotating layer, the exterior rotating layer and glistening pieces floating in the transparent liquid will rotate in the clearance between the interior fixed cup and the exterior fixed cup, and since the heights of the interior rotating layer 12 and the exterior rotating layer 13 are in inverse proportion, when the interior rotating layer 12 is higher and the exterior rotating layer 13 is lower, the exterior rotating layer 13 will be floating and rotating up and down in the transparent liquid, or vice versa. Since the heights of the interior rotating layer 12 and the exterior rotating layer 13 are different, the masses of the interior rotating layer 12 and the exterior rotating layer 13 are also different. As a result, the rotating speeds of the interior rotating layer 12 and the exterior rotating layer 13 are different. And since various figures and patterns are painted on the outside wall of the interior fixed cup 11 and the inside and outside walls of the exterior fixed cup 14, the interior rotating layer and the exterior rotating layer 13, the entire three-dimensional rotating cup will create a dynamic atmosphere; furthermore, since the clearance between the interior fixed cup 11 and the exterior fixed cups 14 is filled with a transparent fluid (such as water or other liquids), there will be a heat-insulating function to insulate the fluid contained inside the three-dimensional rotating cup from outside temperature changes.

This description covers only the preferred embodiment of the subject invention and cannot be used to limit or restrict the scope of the application of the subject invention. All equivalent variations or modifications deriving from the subject claims shall be included in the spirit and intent of the subject claims.

What is claimed is:

1. A three-dimensional rotating cup, comprising:

an exterior fixed cup;

an interior fixed cup having a cup edge;

an interior rotating layer; an exterior rotating layer;

the interior and exterior fixed cups each including inside and outside walls wherein the exterior and interior rotating layers are movably positioned between the exterior fixed cup and the interior fixed cup, the interior rotating layer is positioned between the exterior rotating layer and the interior fixed cup, the outside wall of the interior rotating layer able to contact the inside wall of the exterior rotating layer;

a transparent fluid filling the space between the interior fixed cup and the exterior fixed cup, the transparent fluid acting as insulation; a protruding flange having a bottom extending outwardly from the cup edge of the interior fixed cup; and the bottom of the protruding flange is joined to the top of the cup edge of the exterior fixed cup to seal in the transparent fluid.

2. The three-dimensional rotating cup, as recited in claim 1, wherein the inside and outside walls of the exterior fixed cup and the interior and exterior rotating layers and the outside wall of the interior fixed cup comprise figure paintings.

3. The three-dimensional rotating cup, as recited in claim 1, wherein the longitudinal length of the interior rotating layer is different from the longitudinal length of the exterior rotating layer.

* * * * *